United States Patent [19]

Rausing

[11] 4,132,051

[45] Jan. 2, 1979

[54] METHOD FOR THE MANUFACTURE OF PACKING CONTAINERS

[75] Inventor: Ruben A. Rausing, Rome, Italy

[73] Assignee: Tetra Pak Developpement SA, Lausanne, Switzerland

[21] Appl. No.: 813,691

[22] Filed: Jul. 7, 1977

[30] Foreign Application Priority Data

Jul. 15, 1976 [CH] Switzerland ..... 9114/76

[51] Int. Cl.[2] ..... B65B 3/02; B65B 9/12

[52] U.S. Cl. ..... 53/452; 53/140; 156/244.14; 156/244.19

[58] Field of Search ..... 53/28, 29, 30 R, 140, 53/141; 156/244, 500, 244.14, 244.19, 244.21; 264/96, 150, 209

[56] References Cited

U.S. PATENT DOCUMENTS

| | | | |
|---|---|---|---|
| 2,616,232 | 11/1952 | Meyer | 53/29 |
| 2,827,742 | 3/1958 | Bursak | 53/180 M |
| 2,872,766 | 2/1959 | Meissner | 53/140 X |
| 2,962,843 | 12/1960 | Hoelzer et al. | 53/28 X |
| 3,306,001 | 2/1967 | Peppler | 53/28 X |
| 3,993,810 | 11/1976 | Bonis | 156/244 |
| 4,021,283 | 5/1977 | Weikert | 53/29 X |

FOREIGN PATENT DOCUMENTS

| | | | |
|---|---|---|---|
| 291836 | 2/1971 | U.S.S.R. | 53/140 |

*Primary Examiner*—Robert Louis Spruill

*Attorney, Agent, or Firm*—Burns, Doane, Swecker & Mathis

[57] ABSTRACT

A method of manufacturing packing containers from a thin flexible plastic material intended to be enclosed within an outer shell of stiffer material for reinforcing purposes in which a plastic tube is extended from an annular extrusion die into which a filling pipe extends. The filling pipe is divided into a number of branch pipes arranged in a row and each of these branch pipes is entered into a corresponding longitudinally extending section of the interior of the extruded tube established between parallel spaced sealing zones formed between the front and back walls of the extruded tube which is expanded and thereafter somewhat flattened for this purpose. Longitudinally spaced transverse sealing zones are then formed across the flattened and filled tube sections and cuts are then made through the longitudinally and transversely extending seaing zones thus dividing them into individual filled containers.

10 Claims, 2 Drawing Figures

METHOD FOR THE MANUFACTURE OF PACKING CONTAINERS

Figure 1:
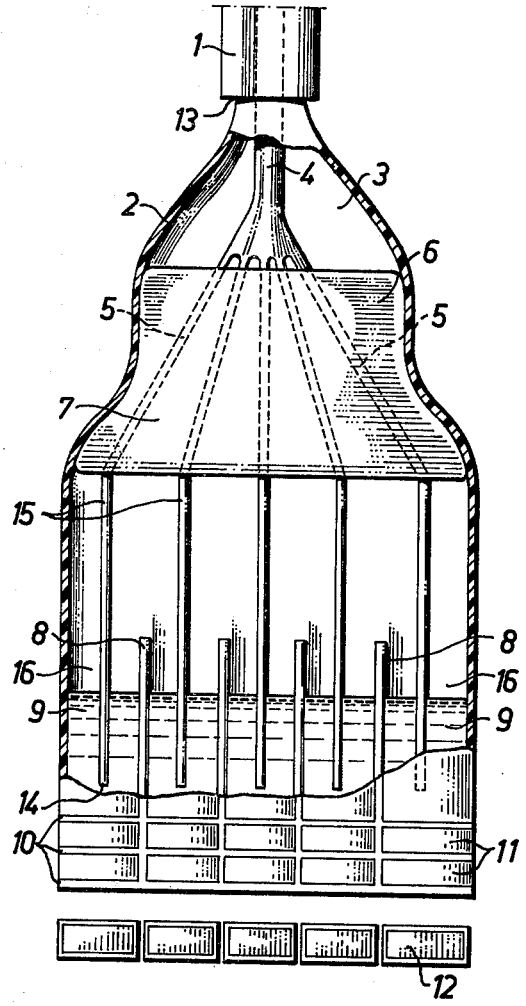

The present invention relates to a method for the manufacture of packing containers from a tube with substantially greater diameter than the corresponding dimension of the packing containers. The invention also relates to arrangements for the realization of the method.

It is desirable in the technology of packing, inter alia, to pack, in particular liquid goods, in relatively thin-walled plastic packages which are subsequently enclosed in casings or outer shells of a stiffer material. The reason for the use of such a package design is primarily its low price, but technical advantages are also attained by means of this design. Thus it is possible e.g. when a pressurized liquid, e.g. beer, is packed, to enclose the liquid contents in a plastic tube which has the required barrier characteristics, that is to say it should be relatively impervious to gases such as carbon dioxide and oxygen while the outer casing or the outer shell is adapted so that it tightly encloses the inner plastic tube and absorbs the stresses emanating from the contents which the plastic tube itself is not capable of absorbing without bursting or at least becoming greatly deformed. In packages which are intended for milk or similar, non-pressurized liquids there is no problem of the inner plastic container having to be supported so that it does not burst, but it is owing to the very absence of an inner pressure that the plastic tube or plastic container has a very non-defined form and becomes difficult to handle if it is not enclosed in a stiffer outer casing or an outer shell. Packages of the above-mentioned type are popularly known as "bag in the box" and have long been in existence in many variants. In general these packages are manufactured so that the inner tube or bag package is made from a packing material prepared in advance, which is formed to a bag or tube and is filled with the intended contents. These known processes are difficult to apply, however, to the packaging of e.g. sterile milk which has to be packed in a sterile packing material under aseptic conditions.

In accordance with the present invention a packing container which in the manner described above is intended to be enclosed in a shell or acasing, is manufactured directly by extrusion of a plastic tube, the contents being supplied through a pipe which is arranged in the extrusion die in such a manner that it opens into the tube extruded through the annular extrusion die, which tube following the extrusion is inflated in a known manner so that the tube diameter is increased considerably at the same time as the plastic material is molecular-oriented.

This method too is known in itself in the technology of packaging, but the difficulty is that at the same time as the extruded plastic tube is inflated to an appreciably greater diameter than the diameter of the annular extrusion die, there must be room in the extrusion die for introducing the filler pipe. Since the inner plastic tube or plastic container of a normal consumer package of beer or milk has relatively small dimensions and the increase in diameter after extrusion should preferably be several 100%, it will be readily understood that it is difficult to combine an extruder with sufficiently small diameter with a filler pipe with sufficiently large diameter. This technical problem has been solved by the present invention, which is characterized in that the tube after inflation is shaped so that it obtains an elongated cross-section, that the said tube with the help of sealing elements arranged in parallel is divided up into a number of parallel partial tubes which are joined together along the sealed areas, that the said partial tubes are filled with the intended contents and are sealed to closed containers by means of successive transverse seals at a distance from one another, perpendicularly to the longitudinal axis of the extruded tube, and that the sealed partial tubes are separated to individual container units by cutting through the said longitudinal and transverse sealing zones.

Figure 2:
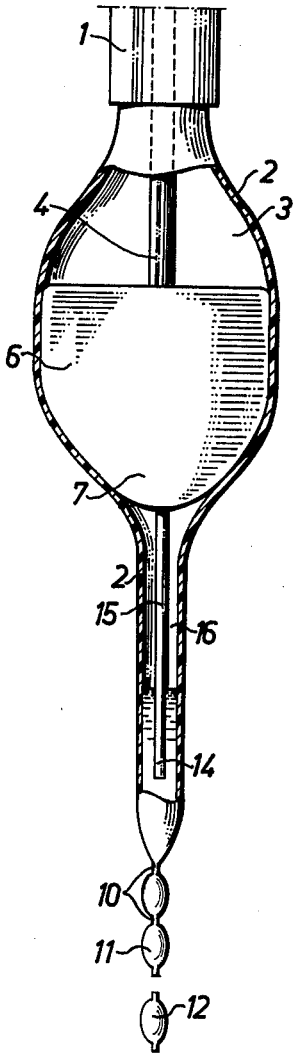

In the following the invention will be described with reference to the enclosed schematic drawing, in which FIG. 1 shows schematically the package manufacture, while FIG. 2 is a side view of FIG. 1.

The technique of packaging pressurized liquids differs in some parts appreciably from the technique of packaging e.g. milk, but since the concept of the invention can be applied to both types of contents, only a joint description will be given in the following.

In the drawing an extrusion die is marked 1 and the annular gap of the extrusion die bears numeral 13. Through the annular extrusion die 1 passes a filler pipe 4 for supplying the intended contents to the packing units produced. The filler pipe 4 branches out into a number of smaller branch pipes 5 which present parallel branch elements 15 located at a distance from another, whose outlets are marked 14.

The arrangement includes moreover a cooling element 6 which is preferably cooled with water in a conventional manner, not shown here. The cooling element 6 is designed so that its upper part facing the extrusion nozzle 1 has a circular-cylindrical cross-section while its lower parts 7 have an elongated cross-section, but the cooling element 6 shall be constructed so that the circumference along a section taken perpendicularly to the axis of symmetry of the cooling element 6 is the same irrespectively of where the section is taken. In FIG. 1 the contents filled into the container are marked 9 and the longitudinal seals of the extruded tube 2 are designated 8. The sealing devices for realizing the longitudinal seals 8 are not shown, but these sealing devices may be of the conventional type and may be constituted e.g. of sealing elements in the form of rollers which roll continuously against the extruded tube laid flat, and between the rollers seal the material layers pressed together to one another. In this case one or both of the co-operating pressure rollers may be heated. Another method consists in the use of elongated sealing elements which are made to engage successively with the tube, and it is also possible to arrange the said sealing elements on continuously moving chains. The tube divided up by longitudinal sealing zones 8 presents after the said sealing operation a number of partial tubes 16 which in the case shown here number five, but which may very well be ten or more. Into each one of the said partial tubes 16 opens one of the branch pipes 15 of the filler pipe 4, so that contents 9 are introduced into each partial tube through the outlets 14 of the filler pipe 4.

After the contents 9 have been introduced, all partial tubes 16 are divided by transverse seals perpendicularly to the tube axis, so as to form wholly enclosed packaging units 11. The said transverse seals are designated 10 and may be realized by conventional sealing elements such as those e.g. which are arranged on continuously rotating chains. The individual packages 12 are separated by cutting through the said sealing zones 10 and 8.

In the case shown here, the packing units are divided so that they have their longitudinal axis oriented perpendicularly to the longitudinal axis of the extruded tube, owing to the fact that the distance between the transverse seals 10 is appreciably smaller than the distance between the longitudinal tube seals 8. Naturally the sealing pattern can also be arranged in such a manner, that the distance between the longitudinal seals 8 becomes less than the distance between the transverse seals 10, the individual packing containers being then oriented so that their longitudinal axis coincides with the longitudinal axis of the extruded tube.

The arrangement shown in FIG. 2 is a side view of the arrangement according to FIG. 1, and for the sake of clarity the same reference numerals have been used to indicate the details on the arrangement in FIG. 1 and 2.

The mode of operation of the arrangement is as follows:

Through the extrusion die 1 a tube 2 of plastic material is extruded through the annular extrusion die 13. The tube 2 which is extruded may consist either of only one material, e.g. an acrylonitrile material known under the trade name BAREX, or a number of plastic materials may be extruded together or be co-extruded in such a manner that the resulting tube 2 will be a laminate containing a number of plastic materials. Thus it is conceivable that the tube might consist of a laminate combination between acrylonitrile material (BAREX) and polyethylene, and it is also possible for a further binder layer to be included in the laminate, e.g. a binder which is marketed under the trade name SURLYN. Beside the acrylonitrile material mentioned here a laminate comprising polyvinylidene chloride of the type which is marked under the name SARAN may be used, and if the packing containers are to be used for pressurized contents, e.g. beer or carbonated beverages, it may be expedient to have a material with the capacity of absorbing great tensile stresses, e.g. polyester.

In the space 3 between tube 2, extruder 1 and cooling element 6 a very slight excess pressure should prevail, so that the tube 2 will be inflated to a diameter which is appreciably greater than the diameter of the extrusion die 13. However, the pressure in the space 3 must not be too high, since the tube would then be inflated so much that it might burst. It has been found in fact that the pressure inside the space 3 should be very close to atmospheric pressure, but a certain excess pressure must prevail for the inflation to take place. The extruded and inflated tube 2 is drawn over a cooling element 6 whose upper part has a circular-cylindrical shape and whose bottom part has a "flattened" shape. During the passage over the cooling element 6 the plastic material is stabilized and comes to lie so tightly against the same that in actual fact the cooling element 6 constitutes a plug or seal which closes the connection between the space 3 and the area of the tube 2 below the cooling element 6. Through the cooling element 6 passes a filler pipe 4 by means of which the intended contents can be supplied to the packing units formed and the said filler pipe 4 branches out to diverging branch pipes 5, the lower ends of which form branch pipes 15 arranged parallel with one another.

The tube 2, substantially lying flat, is divided in its longitudinal direction into a number of partial tubes 16 by longitudinal continuous sealing zones 8, which are arranged at a mutually equal distance from one another so that the partial tubes 16 will be of equal size. The said longitudinal seals 8 are realized with the help of sealing elements, not shown here, which may be of any conventional type giving continuous sealing by the fusing together of the plastic layers in the tube 2 pressed against one another.

The aforementioned parallel branch pipes 15, through which the intended contents are supplied, are preferably arranged to project down into the partial tubes 16 which are formed by the longitudinal seals 8. The contents are introduced through the outlets 14 of the branch pipes 15 in such a manner that the level of the contents is always located above the outlets 14. The longitudinally sealed and filled partial tubes 16 are then divided to wholly closed packing units by means of transverse seals 10 which are also realized by means of conventional sealing elements, which act so that heat is supplied in an area in which the plastic layers, which are to be sealed, are pressed hard to one another. After the sealing along the transverse sealing zone 10, the individual packing units 12 are separated by cutting through the said sealing zones 10 and 8, whereupon the filled and sealed packing units 12 are introduced into an outer shell or are enveloped by a pressure-absorbing band.

The type and construction of the outer shell can vary within wide limits and has no direct connection with the method in accordance with the invention which is concentrated on the method of manufacture of the inner, thin-walled plastic container wherein the contents are enclosed and which presents the required barrier characteristics against gases.

As mentioned above, the technique of packaging of such different contents as beer and milk varies considerably, but the method in accordance with the invention can still be applied to the packaging of both types of contents. In the packaging of beer, however, it is necessary in certain cases to arrange parallel with the filler pipe 15 a thinner pipe for the extraction of the froth formed. This tendency of the beer to froth may be considerably reduced, however, if the filling is done at low temperature. It is also conceivable in the packaging of beer that carbon dioxide may have to be supplied through a special feed line, which may then also be arranged parallel with the filler pipe 15. In most cases it will not be necessary, though, to supply any carbon dioxide, since the beer itself emits carbon dioxide gas.

When filling milk the frothing problem is considerably less, but so as to be sure that all the oxygen has been excluded and that the space 3 close to the extrusion die 1 has been ventilated from illsmelling plastics gases, it may be appropriate to arrange a ventilation by simultaneous supply of nitrogen gas and extraction of the corresponding quantity of gas from the space 3. It is also possible to supply nitrogen gas to the partial tubes 16 so as to maintain such a pressure in them that the package walls will be well dilated during the sealing operation.

As mentioned previously, the material in the tube 2 may consist of a laminate which is co-extruded and which comprises an acrylonitrile material layer of the type which is marketed under the trade name BAREX and a layer of polyethylene or possibly polyester. It may be advantageous in certain cases to extrude as an intermediary layer between the acrylonitrile material and the polyethylene material a binder layer of the type which is marketed under the trade name SURLYN since otherwise there is a risk of delamination between the co-extruded plastic layers.

The packaging machine described here can easily be made so, that it can be changed over between different package sizes in that the sealing elements, by means of which the longitudinal seals 8 are formed, are displaced in relation to one another so that they will be closer to or farther away from each other, as a result of which the packing containers obtain a different length. It is also possible to divide the same tube into a number of smaller, but mutually differently sized partial tubes, for the purpose of a simultaneous production of packages with different volume. It is of course possible in the same manner to alter the position of the transverse seals 10 successively following one another, so that the bag-like plastic containers formed obtain greater or smaller width, and relatively great freedom exists thus in being able, with the help of the mutual position of the sealing elements, to vary the size of the packages, which gives the packaging machine a great flexibility.

The above description was wholly based on the assumption of a seamless plastic tube being extruded from an annular extrusion die, this plastic tube with large diameter being divided into a number of smaller partial tubes which are simultaneously filled and closed. In certain cases it may be expensive and awkward to operate with a plastic tube extruder in e.g. dairy or brewery surroundings, because, among other reasons, such an extruder requires expert care and handling, and moreover represents a large investment capital. A modification of the invention can be that one sets out from a wide, prefabricated web, which web is converted to a tube by joining together the edges of the web in a sealing joint, so as to form a tube of a relatively large diameter. This large tube is then divided into a number of smaller partial tubes in that parallel longitudinal seals are arranged. Hence in this case a prefabricated laminate web is used instead of extruding the packing material directly in conjunction with the packing operation.

It has been found that by application of the method in accordance with the invention a very large production capacity, reckoned in the number of packing units produced per unit of time, can be achieved, at the same time as the disadvantages are avoided which may arise in the manufacture of packages from a single, undivided tube, which difficulties, as mentioned previously, consist in that the extrusion die will be too small to permit sufficient inflation of the tube at the same time as the filler pipe will be too small to allow a sufficient amount of filling goods to be introduced through the extrusion die.

I claim:

1. A method of manufacturing individual container units comprising the following steps:

extruding a tube of plastic material through an annular extrusion die to obtain a cylindrical tube having a first diameter and a longitudinal axis;

biaxially stretching the extruded tube by inflating the tube to a second diameter that exceeds the first diameter and stretching the tube along the longitudinal axis;

cooling the extruded tube while drawing over an internally disposed cooling element;

laterally elongating the tube keeping the perimeter constant while drawing the tube over the internally disposed element;

dividing the laterally elongated tube into a plurality of longitudinal tubes with longitudinal sealing elements, the longitudinal tubes being joined along longitudinal sealed areas;

filling the longitudinal tubes;

successively sealing the longitudinal tubes transversely of the longitudinal axis to form closed containers joined along transverse sealed areas; and cutting through the longitudinal and transverse sealed areas to separate the transversely sealed longitudinal tubes into individual container units.

2. A method in accordance with claim 1 including spacing the distance between the successive transverse seals to be appreciably greater than the distance between adjacent longitudinal seals of the extruded tube.

3. A method in accordance with claim 1 including spacing the distance between the successive transverse seals of the tube to be appreciably smaller than the distance between adjacent longitudinal seals of the extruded tube.

4. A method in accordance with claim 1 wherein the step of laterally elongating includes transforming a circular-cylindrical extruded tube with the cooling element to an elongated configuration.

5. A method in accordance with claim 4, further including the step of holding the tube circumference, taken in a section perpendicular to the longitudinal axis, constant while performing the transforming.

6. A method in accordance with claim 1, wherein the filling step includes passing a common main line through the extrusion die and the cooling element, and diverging the main line to a number of parallel branch pipes, the combined area of which substantially corresponds to the area of the main line, and whose mutual distance substantially corresponds to the distance between the longitudinal tubes.

7. A method in accordance with claim 1, further including the step of simultaneously extruding the said tube of plastic material from at least two material layers of different plastic material.

8. A method in accordance with claim 7, including making up the tube from an acrylonitrile material and at least one layer of a polyolefin.

9. A method in accordance with claim 1, further including the step of displacing transverse sealing elements in relation to one another when changing to a different package size.

10. A method in accordance with claim 1, including the step of ventilating the space between the extrusion die and the cooling element by continuously introducing air while removing a corresponding quantity of air.

* * * * *